US006571878B2

(12) United States Patent
Mc Daniel et al.

(10) Patent No.: US 6,571,878 B2
(45) Date of Patent: Jun. 3, 2003

(54) SMOOTH BUOYANCY SYSTEM FOR REDUCING VORTEX INDUCED VIBRATION IN SUBSEA SYSTEMS

(75) Inventors: Richard Bruce Mc Daniel, Houston, TX (US); Donald Wayne Allen, Katy, TX (US); David Wayne McMillian, Deer Park, TX (US); Kenneth Dupal, Mandeville, LA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/912,939

(22) Filed: Jul. 25, 2001

(65) Prior Publication Data

US 2002/0112858 A1 Aug. 22, 2002

Related U.S. Application Data

(60) Provisional application No. 60/221,949, filed on Jul. 31, 2000.

(51) Int. Cl.[7] ..... E21B 17/01; E21B 31/00; E02D 5/56

(52) U.S. Cl. ..... 166/367; 166/350; 405/242.5; 405/216; 114/243

(58) Field of Search ..... 166/367, 350; 405/242.5, 171, 216, 211; 114/243

(56) References Cited

U.S. PATENT DOCUMENTS

| | | | | | |
|---|---|---|---|---|---|
| 3,581,449 | A | | 6/1971 | Assling et al. | 52/84 |
| 3,768,842 | A | * | 10/1973 | Ahlstone | 138/141 |
| 4,021,589 | A | * | 5/1977 | Copley | 264/DIG. 6 |
| 4,073,983 | A | | 2/1978 | Van Cleave | 427/421 |
| 4,176,986 | A | * | 12/1979 | Taft et al. | 166/350 |
| 4,239,417 | A | * | 12/1980 | Slatten et al. | 166/356 |
| 4,332,509 | A | * | 6/1982 | Reynard et al. | 138/111 |
| 4,398,487 | A | * | 8/1983 | Ortloff et al. | 114/243 |
| 4,470,722 | A | * | 9/1984 | Gregory | 166/350 |
| 4,634,314 | A | * | 1/1987 | Pierce | 166/350 |
| 4,636,114 | A | * | 1/1987 | Hale | 166/367 |
| 4,646,840 | A | * | 3/1987 | Bartholomew et al. | 166/350 |
| 4,909,327 | A | * | 3/1990 | Roche | 166/359 |
| 5,259,701 | A | * | 11/1993 | Gerhart et al. | 106/15.05 |
| 5,330,294 | A | * | 7/1994 | Guesnon | 166/350 |
| 5,421,413 | A | * | 6/1995 | Allen et al. | 166/335 |
| 6,019,549 | A | * | 2/2000 | Blair et al. | 24/460 |
| 6,048,136 | A | | 4/2000 | Denison et al. | 405/211 |
| 6,148,751 | A | * | 11/2000 | Brown et al. | 114/264 |
| 6,179,524 | B1 | * | 1/2001 | Allen et al. | 114/263 |
| 6,206,614 | B1 | * | 3/2001 | Blevins et al. | 114/264 |
| 6,223,672 | B1 | * | 5/2001 | Allen et al. | 114/243 |
| 6,257,337 | B1 | * | 7/2001 | Wells | 114/243 |
| 6,401,646 | B1 | * | 6/2002 | Masters et al. | 114/243 |

FOREIGN PATENT DOCUMENTS

| | | | |
|---|---|---|---|
| WO | 98/27373 | * | 6/1998 |
| WO | 01/19669 | * | 3/2001 |

OTHER PUBLICATIONS

D. W. Allen and D. L. Henning, Vortex–Induced Test of a Flexible Smooth Cylinder at Supercritical Reynolds Numbers, dated May 1997.*

Graham, Flow Past a Cylinder, 4 pages, download from *http://astron.berkeley.edu/~irg/av202/lectures/node18.html.*

Vortex Shedding Behind a Circular Cylinder, 4 pages, downloaded from *http://sintef/.no/nhl/vass/cylinder.html.*

(List continued on next page.)

*Primary Examiner*—Thomas B. Will
*Assistant Examiner*—Thomas A. Beach

(57) ABSTRACT

Smooth buoyancy cylindrical elements having a surface roughness coefficient of K/D less than or equal to $1\times10^{-4}$, where K is the average peak-to-trough roughness and D is the effective outside diameter of said the cylindrical element are affixed about marine elements to decrease vortex induced vibration, thereby decreasing stress and loading on the marine elements.

19 Claims, 6 Drawing Sheets

OTHER PUBLICATIONS

Mikolaitis, University of Florida, Friction Factor Calculator, 1 page, downloaded from http://grumpy.aero.ufl.edu/gasdynamics/colebrook10.html.

Selens. MECH 441. Losses in Piping, 4 pages, Revised Sep. 9, 1996, downloaded from *http://sellensr.me.queensu.ca/sellens/441/losses.htm*.

CEM/ME 101abc.Handout#5, Incompressible Flow over a Circular Cylinder, 5 pages, dated 1982, Downloaded from *http://green.caltech.edu/–colonius/me101/ho5/ho5.html*.

Masad, Transition Prediction in Flow of Roughness Elements, 2 pages, downloaded from *http://sti.larc.nasa.gov/randt/1994/3–SectionB1.www38.html*.

Drag of Blunt Bodies and Streamlined Bodies, 4 pages, downloaded from *http://www.princeton.edu/~asmits/Bicycle–web/blunt.html*.

E–mail dated Aug. 20, 2001, from Professor and Chairman of Mechanical and Aerospace Engineering Alexander J. Smith, Princeton University, to Patent Examiner Katherine Mitchell.

Engineering Fluid Mechanics, Figures 10.8 and 10.9, pp. 428 and 429.

Harris Shock and Vibration Handbook, Vibration of Structure Induced by Fluid Flow, R. D. Blevins, pp. 29.1–29.67.

Oil and Gas International, Mitigating vortex–induced vibrations, pp. 1–3, downloaded from *http://www.oilandgasinternational.com/departments/technical–reports/vortex–induced.html*.

* cited by examiner

SMOOTH BUOYANCY SYSTEM FOR REDUCING VORTEX INDUCED VIBRATION IN SUBSEA SYSTEMS

RELATED APPLICATIONS

The present application is a conversion of and claims priority to U.S. Provisional Application No. 60/221,949, filed Jul. 31, 2000, assigned to the assignee of the present invention and having at least one common inventive entity.

BACKGROUND OF THE INVENTION

Exploration and production of hydrocarbons from subsea reservoirs is an expensive and time-consuming process. The drilling and production processes often require allocation of expensive assets, such as drilling and production platforms located offshore. There are a number of problems associated with offshore drilling and production that not found in land operations.

Primary among these is the marine environment. Drilling equipment is subject to ocean currents. The currents apply forces on subsea elements, subjecting them to additional loading and stress. The currents also can present a problem with maintaining the drilling platform at a desired location. Moreover, unlike the surface environment, offshore drilling control equipment is generally located on the seabed and not subject to direct control and monitoring—one simply cannot see the equipment without the use of vision equipped ROVs. The marine environment also presents a biological challenge in that marine organisms may congregate and grow on subsea equipment, possibly interfering with operations. Yet another problem is the chemistry of the marine environment. Salt in the water creates an environment that can promote cathodic attack on subsea equipment. This environment can affect all marine elements from moorings, tendons, tension leg platforms, as well as drilling and production risers.

The mechanics of drilling in a marine environment also differ from land operations. Drilling operations utilize a drilling fluid, known as "mud" which is pumped down the drill string and circulated back to the surface through an annulus between the drill string and the borehole wall. The drilling mud cools the drill bit as it rotates and cuts into the earth formation. It also provides a medium for returning drilling cuttings created by the drill it to the earth's surface via the annulus. The weight of the drilling mud in the annulus further operates to control pressure in the borehole and help prevent blowouts. Lastly, additives in the mud are designed to form a cake on the inside walls of the borehole to provide borehole stability and to prevent formation fluids from entering the borehole prior to desired production. It will be appreciated that during land operations, the drilling mud and cuttings may be readily returned to the surface via the borehole annulus. Such is not the case in offshore operations.

Offshore operations require location of a drilling platform in waters located generally above the reservoir of interest. The depth of the water may range from several hundred feet to almost half a mile. A drill string must travel from the surface of the platform, down to the seabed and then into the formation of interest prior to actually beginning cutting operations. Unlike land operations, there is no annulus between the floor of the seabed and the drilling platform at the surface. Accordingly, a drilling "riser" comprised of generally cylindrical elements is provided for from below the seabed to the surface drilling platform above the water level. The riser operates to protect the drilling string during operations and acts as an artificial annulus.

The risers are formed from large (on the order of 21 inches) diameter metal tubular goods linked together. Buoyancy elements, often manufactured from synctatic foam or metal, may be affixed the external surface of the drilling riser along its length to provide essentially neutral buoyancy. The synctatic foam buoyancy elements are typically 6–12 feet in length. The specific foam chemistry and diameter of the float are selected in accordance with the specific environmental conditions to be encountered in operations. Riser joints may be as long as 75 feet or more in length and multiple buoyancy-elements may be affixed to a single riser joint. The buoyancy elements are generally manufactured onshore and shipped, together with the riser joints, to the drilling platform prior to use. The buoyancy elements are usually installed on the riser prior to riser installation. The foam floats may be affixed about the riser elements any number of ways as will be discussed with reference to the preferred embodiments of the invention.

Often, the riser and other subsea elements, including buoyancy elements, is subjected to ocean currents along its length, causing lateral deflection in the riser from the seabed to the surface platform. A riser may be subjected to varying and differential ocean currents along its length resulting in complex lateral deflection of the riser. This results in a number of problems. The continued deflection of the riser may result is stress points along its length and ultimately weaken the riser. Radical lateral deflection in the riser could result in excessive drill string contact with the inside riser wall resulting in further weakening of the riser.

The currents have yet another effect in that they created a drag force on the riser, causing vortexes to shed from the sides of the elements as the currents move around the generally cylindrical elements. These vortexes can cause further increased deflection of the riser. Moreover, they can make it more difficult to keep the drilling platform positioned. These forces may result in excessive drilling angles as seen from the platform, limiting the nature of drilling operations. The vortexes often create a Vortex Induced Vibration (VIV) effect in the riser resulting in further complex dynamic movement in the riser system, which could result in failure of riser structural elements. The drag on a cylindrical body submerged in a moving fluid is related to the Reynolds number for the body, where the Reynolds number is defined as $\rho vd/\mu$, where $\rho$ is the fluid density, v is the fluid velocity, d is a characteristic length, and $\mu$ is the fluid dynamic viscosity.

A number of different solutions to deal with the problem of VIV, including the use of wing-like fairings enclosing the buoyancy elements to reduce vortex effects as disclosed in U.S. Pat. No. 6,048,136, assigned to the assignee of the present invention. However, there are a number of problems associated with the use of fairings. They typically do not fit through the rotary table of a drilling rig and must be added below the table. Further, there are additional storage and handling problems associated with the use of fairings.

Yet another approach is the use of smooth cylindrical riser elements having Reynolds numbers in excess of 100,000, as disclosed in U.S. Provisional Application No. 60/154,289, filed Sep. 16, 1999, likewise assigned to assignee of the present invention.

SUMMARY OF THE INVENTION

The present invention is directed to an apparatus and method to reduce drag and resulting vortex induced vibrational loading and stress in drilling and production risers, moorings and other subsea elements through the use of buoyancy elements having an ultra-smooth surface applied to the buoyancy element.

BRIEF DESCRIPTION OF THE DRAWINGS

The brief description above, as well as the further objects and advantages of the present invention, may be more fully understood with reference to the following detailed description of the preferred embodiments, when considered in conjunction with the accompanying drawings, in which.

DETAILED DESCRIPTION OF THE PREFERRED EMBODIMENT

Figure 1:
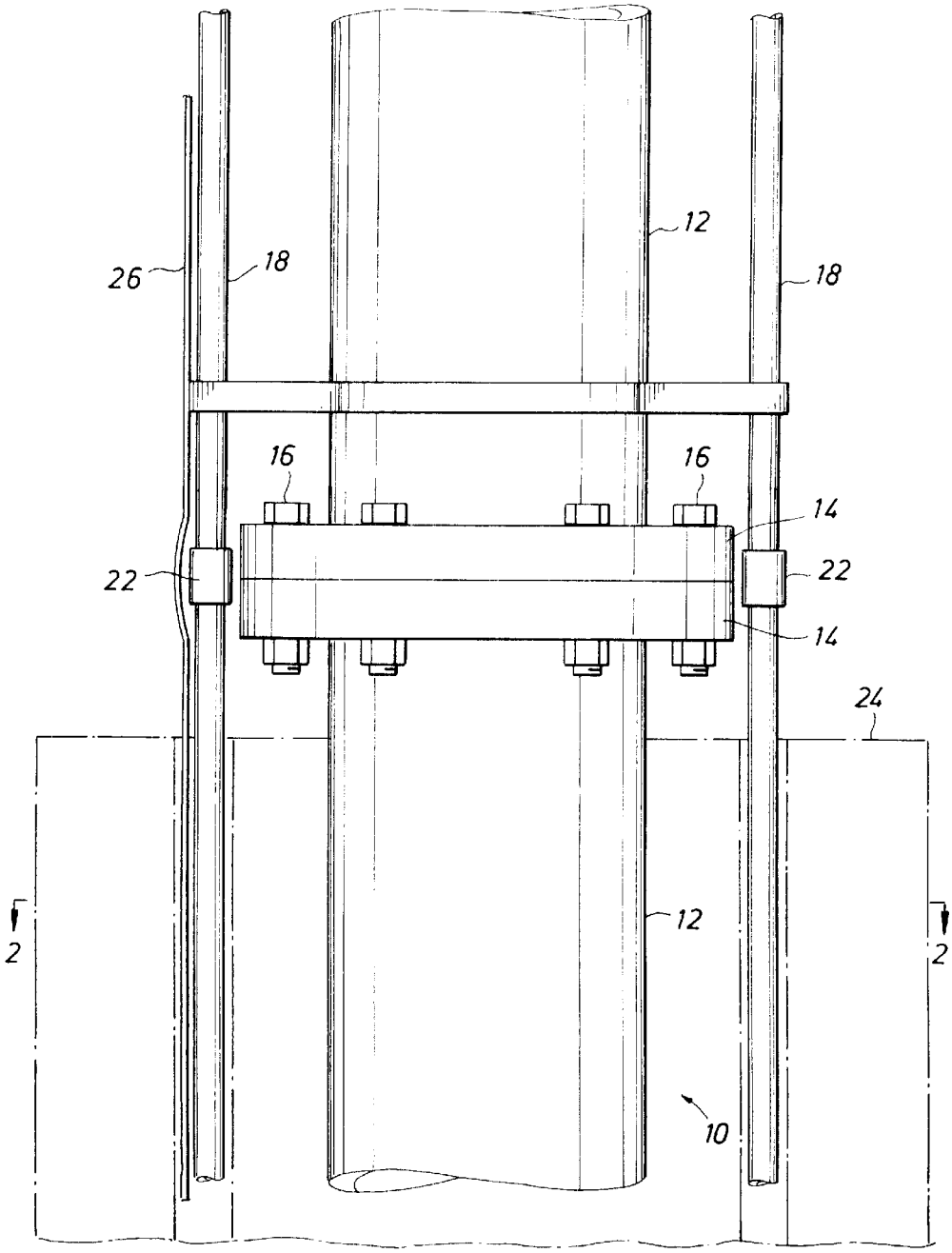
FIG. 1 is a side cross-sectional view of a buoyancy element of one embodiment of the present invention installed about a drilling riser.

FIG. 1 is a side view of a preferred embodiment of the invention consisting of a drilling riser as used in conjunction with the present invention. The riser 10 is comprised of multiple riser joints 12 of varying length up to approximately 75 feet in length or more. Multiple riser joints 12 are joined together at flange connections 14 and may be secured together by nuts and bolts 16 or clamps (not shown). Alternatively, the riser joints 12 may be joined together by means of slick connector (not shown) wherein the respective ends of riser joints 12 are threaded and mated into a common threaded connector (not shown); or the joints may be welded together in the case of a production riser. Associated with the riser 10 are one or more control lines 18 which may be used to control various subsea equipment, e.g., chokes, blowout preventers, during drilling operations. These control lines 18 may be positioned and retained relative to the riser joints 12 by means of control line brackets 20 along the length of the riser joints 12. The control lines 18 are likewise made up of multiple joints connected by means of threaded connectors 22 at various points along the riser 10. One or more foam buoyancy elements 24 (shown in phantom) may be affixed about the riser joint 12, control lines 18 and control line brackets 20. It will be appreciated that the riser joint 12, while generally cylindrical in nature, when combined with bracket 20, control lines 18 and cable 26, is anything but cylindrical in nature and would result in a high drag coefficient.

The foam elements 24 are typically installed about the riser joint 12, control lines 18 and control line bracket 20 after it has passed below the rotary table and prior to being lowered into the sea. Additionally, a communications and power cable 26 may be affixed to the riser to control down-hole operations or provide a data feedback during drilling operations. The cable 26 may be strung along the riser joints 12 and may be loosely retained thereabout by means of guides 26. It will be appreciated that while the riser 10 and control line 16 may include telescopic joints to permit for expansion and deflection of the riser during operations and as a result of deflection from currents or other forces, the cable 26 does not include this telescoping capability. Accordingly, in most instances it should be loosely retained about the riser 10 to permit the cable 26 to be played out or reeled in from the surface as required.

Figure 2:
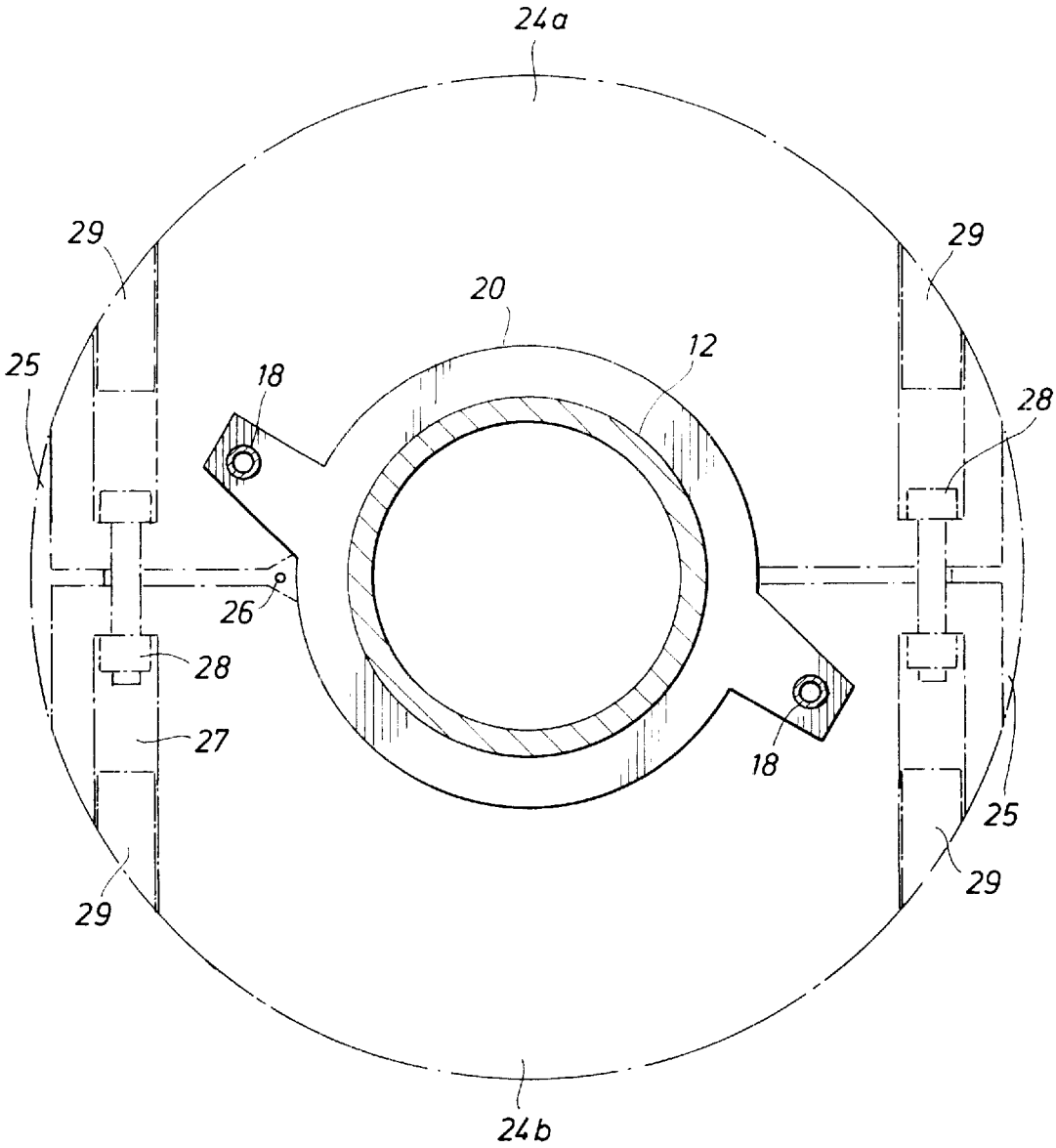
FIG. 2 is an elevational view of the embodiment of FIG. 1.

The foam elements 24 may be manufactured to be affixed to the riser joints in a number of different ways. The foam elements 24 may be manufactured in half shells 24*a* and 24*b* and affixed about the riser joints 12, control lines 18, bracket 20 and cable 26 by means of threaded nuts and bolts 28. In FIG. 2, the foam element is depicted as fitting about the riser joint 12, control line 16, bracket 20 and cable 26. The bolt make up area 27 is further fitted with inserts 29 which may be threadedly inserted matching threads in the make up area 27 to further provide a smooth surface and decrease any vortex effect which may be caused by flow across the make up area 27. Alternatively, the inserts 29 may be molded into the bolt make up area, "snapped" into place, or mechanically attached to the bolt or buoyancy. Lastly, smooth inserts 25 are inserted between foam element halves 24*a* and 24*b* to assure a smooth surface about the entire foam element.

Figure 3:
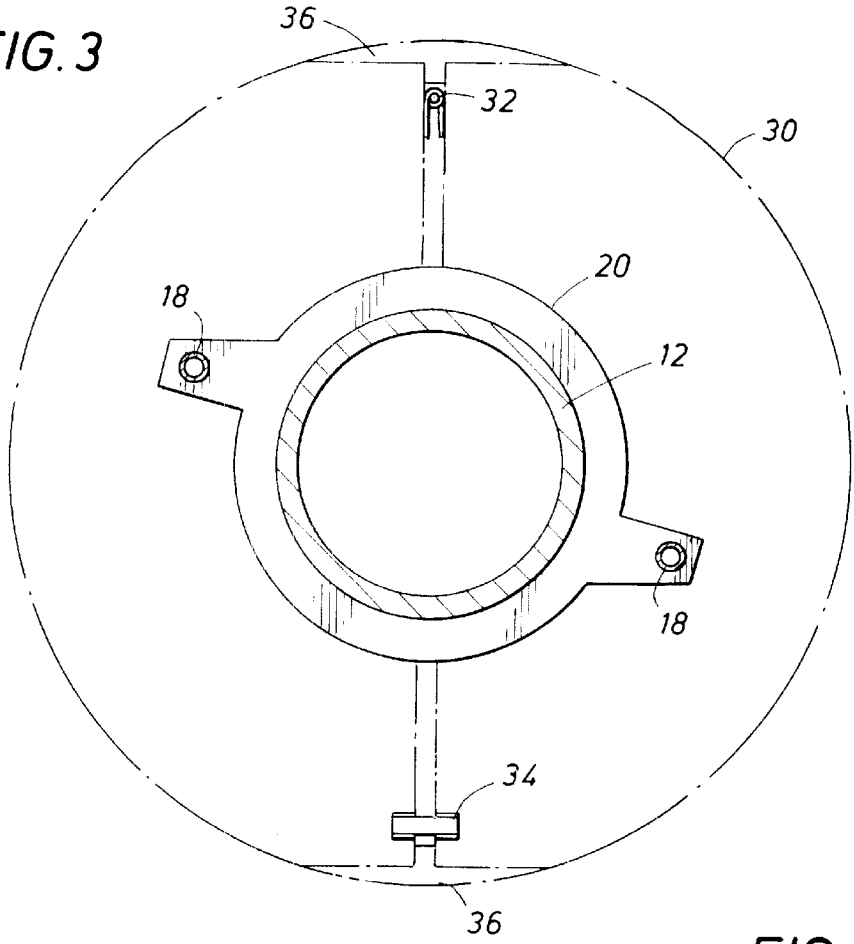
FIG. 3 is a side elevational view of yet another embodiment of the present invention installed about a drilling riser.

In an alternative embodiment as shown in FIG. 3, the foam element 30 may be manufactured having a hinge 32 close about the riser joint 12, control lines 18, bracket 20 and cable 26. The foam element may be secured by a latch 34, or in the alternative, nut and bolt, clamp or other similar mechanical detent. Insert elements 36 are placed in the hinge seam and the latch seam to maintain smoothness about the cylinder.

Figure 4:
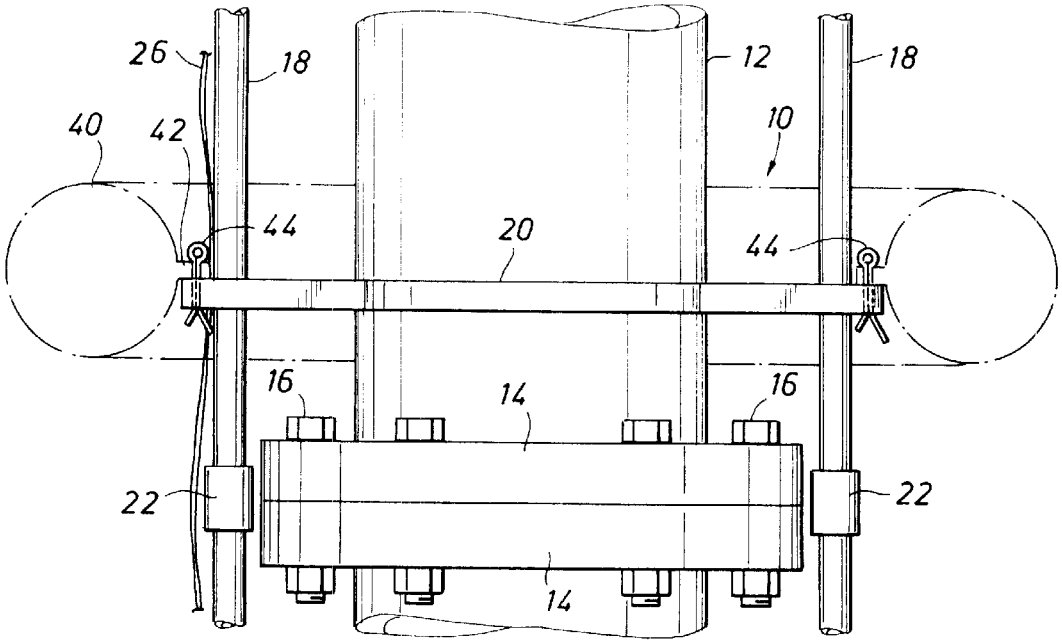
FIG. 4 is an elevational view of another embodiment of the present invention.
Figure 5:
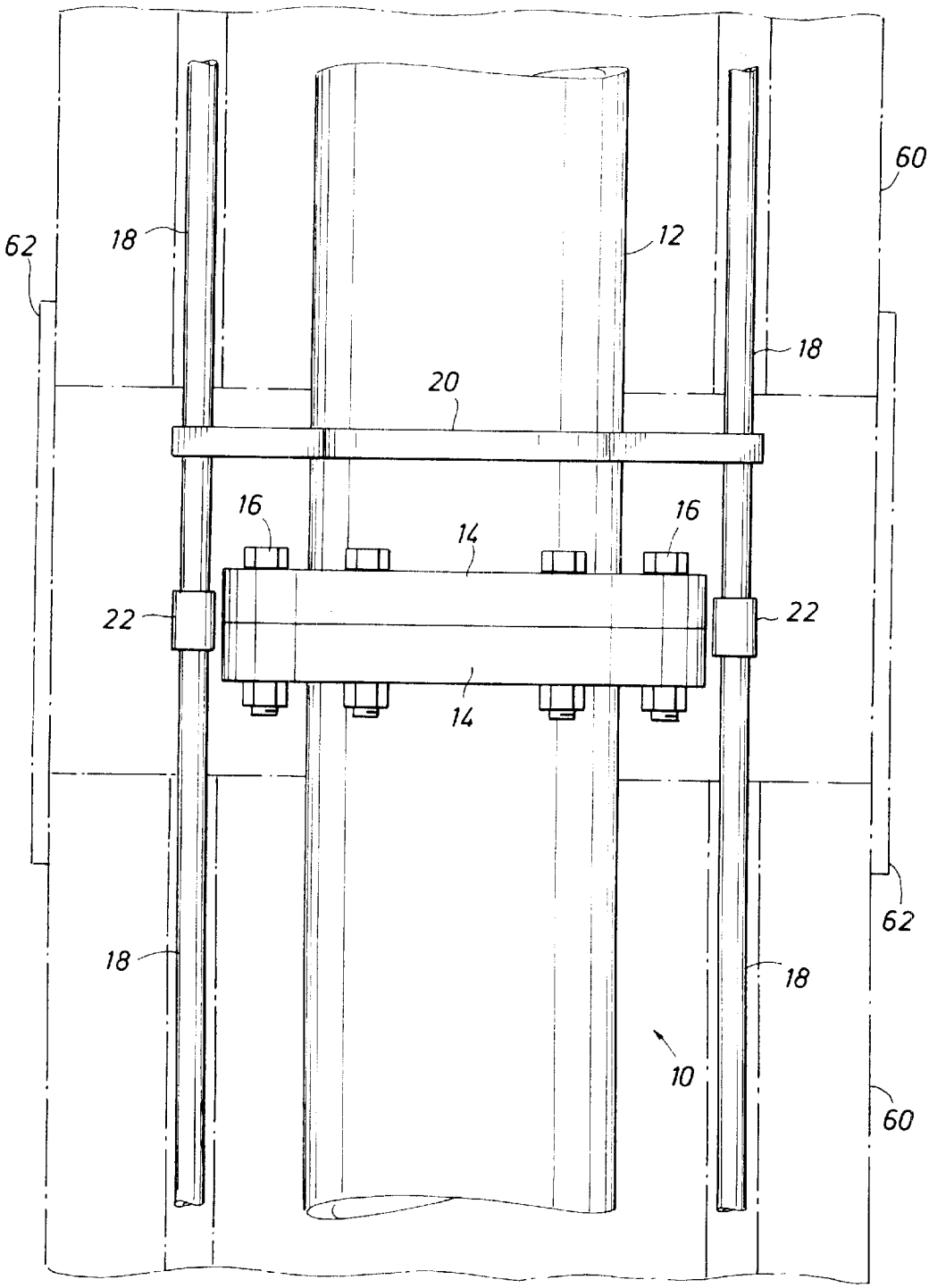
FIG. 5 is an elevational view of the present invention utilizing smooth sleeves disposed between adjoining foam buoyancy elements.
Figure 6:
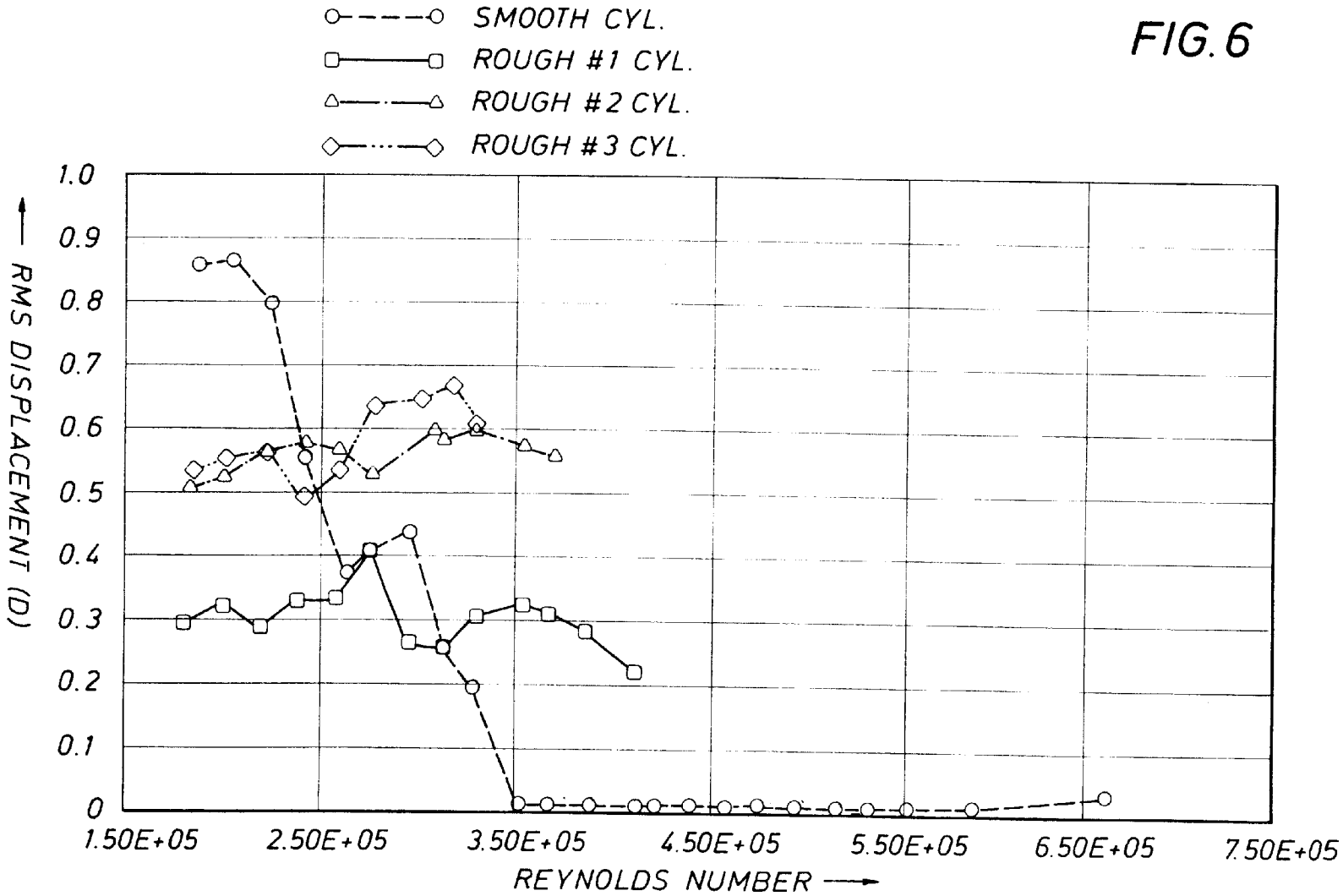
FIG. 6 is a graph of the deflection of cylindrical bodies of varying roughness as a function of the Reynolds number.

Yet another alternative embodiment is set forth in FIG. 4. Therein, a plurality of torroidal foam elements 40 are inserted over the riser joint 12, control line 16, bracket 20 and cable 26, prior to make up with the following riser joint 12. The embodiment of FIG. 4 may further include a mechanical stop to prevent vertical movement of the foam elements 40 along the riser joint 12 following installation. In FIG. 5, the foam element 40 further includes an internal stop 42 which, when rotated into position, engages the bracket 20. The position of the stop 42 and bracket 20 may be fixed by insertion of a retaining pin 44, nut and bolt or other mechanical means. It will be appreciated that while each foam element 40 on riser joint 12 may be so secured to the bracket 20 by means of a stop 42, that only the first such foam element 40 need so be engaged to prevent displacement of the remaining foam elements 40 along the riser joint 12. Further, other stop means such as a stop screw (not shown) may be used to engage the foam element 40 and prevent vertical displacement along the riser joint 12. While FIG. 4 depicts only the lower foam element 40 as being equipped with a stop to fix it axially about the riser joint 12, it will be appreciated that each foam element 40 may be so equipped to fix its movement axially along the riser joint 12. Alternatively, the torroid elements 40 may be manufactured in half sections and secured about the riser joint 12 with bolts and inserts for he bolt make up area and seams (not shown), much the same as shown in FIG. 2

Each of the above embodiments discloses the use of a syntactic foam element to provide buoyancy. However, it will be appreciated that while the surface of the syntactic foam may be relatively smooth, the surface roughness of the foam elements may be sufficiently high as to produce small vortexes in response to ocean currents when installed in a subsea environment. In order to improve the smoothness of the foam elements, 24, 30 and 40, the syntactic foam may be treated with various coatings so as to improve the smoothness of the surface of the foam elements, 24, 30 and 40, thereby reducing the drag coefficient of each element. One typical coating which can be applied to a foam element would be fiberglass gel, which would be applied to the surface of the foam element 24, 30 or 40, which set to form a smooth surface on the foam element. Alternatively, other coatings such as paint may be used to improve surface smoothness. Given the harsh offshore environment, the foam elements 20, 30 or 40 may suffer some surface damage from use or handling. Coatings such as the fiberglass gel or paints may be further utilized to repair the general smoothness of the foam elements, thereby increasing the life of the foam elements.

It will further be appreciated that a riser or other subsea equipment may be subject to differing environmental conditions. A drilling riser, as described above, is typically utilized solely for drilling purposes and may be removed upon completion of the subsea well. However, a production riser may be installed following completion of the well. A production riser is left in place generally during the life of the well. In such instances it may be subject to additional environment factors typically not addressed in the drilling context, e.g., marine growth on the foam elements. In such instances, anti-fouling coatings designed to inhibit marine growth may be applied to the foam elements 24, 30 or 40 in lieu of or in conjunction with the above described coatings. A typical anti-fouling coating may be obtained from manufacturers such as Ceram Kote, Devoe and Sherwin Williams. Further, a production riser, tendon or mooring may be subject to cathodic attack when placed in a marine environment. Accordingly, the foam elements may be further coated with copper based coatings, such as flame sprayed copper coatings or smooth copper sheeting provide cathodic protection for long term emplacement.

In the above embodiments, the foam elements are affixed about the riser joint 12. It will be appreciated that there will exist gaps between the foam elements such that the riser joint 12 and the connections made at the flange (FIG. 1, Item 14) will continue to be subject to exhibit a high drag coefficient in ocean currents when compared to the smooth buoyancy elements disclosed above. Accordingly, another embodiment of the present invention includes the use of smooth sleeves which are disposed between adjacent foam elements. FIG. 5 shows a series of foam elements 60 affixed about a drilling riser joint 12. A smooth sleeve 62 is disposed between adjacent foam elements 60 such that the foam elements 60 are free to axially into and out of sleeve 62. The sleeve 62 may be manufactured from fiberglass, syntactic foam or other suitable material. It will be appreciated that the smooth sleeve 62 inner diameter is sufficient to accommodate the outer diameter of the foam element 60 and permit axial and some lateral deflection of foam element 60. Moreover, a sleeve 62 is shown as being disposed about two adjacent foam elements 60 on separate riser joints, providing for a smooth surface about the flange 14 and nut and bolt 16 connections. Thus the combination of sleeves 62 and foam elements 24, 30 and 40 are capable of providing a smooth surface along the entire length of the riser 10. While the above discussion with respect to buoyancy elements has been with respect to synctatic foam, the same principles regarding smoothness and low drag coefficients may be applied to buoyancy elements manufactured from metal or any other suitable materials.

As noted above the Reynolds number is critical in its effect on drag coefficients for a submerged cylindrical body in a moving fluid. As the drag coefficient of the generally cylindrical riser assembly increases, it is more likely to be susceptible to loading, stress and VIV. The drag coefficient for a cylindrical body decreases rapidly as the Reynolds number increases into the critical range, approximately 200,000 and begins to increase as the Reynolds number increases into the supercritical range on the order of 500,000. It has been determined that a smooth cylindrical body does not experience VIV in a Reynolds number range of approximately 200,000 to 1,500,000. Moreover, as the smoothness of the cylinder increases, the Reynolds number range in which VIV effects are negligible increases. Drag and VIV effects are reduced with a Reynolds number as low as 100,000.

The relationship between drag, VIV and surface smoothness/roughness has been empirically determined and is quantifiable as a dimensionless ratio, K/D, where:

K is the average peak-to-trough distance of the surface roughness; and

D is the effective outside diameter of the cylindrical element.

K is typically measured with an electron microscope utilizing a confocal scanning technique for small surface protrusions, and with a profilometer for large surface protrusions or surface protrusions over a large area. The VIV effects of a submerged cylindrical body substantially decreases where K/D is less than $1\times10^{-4}$ and is significant where K/D is equal to or less than $1\times10^{-5}$.

Figure 7:
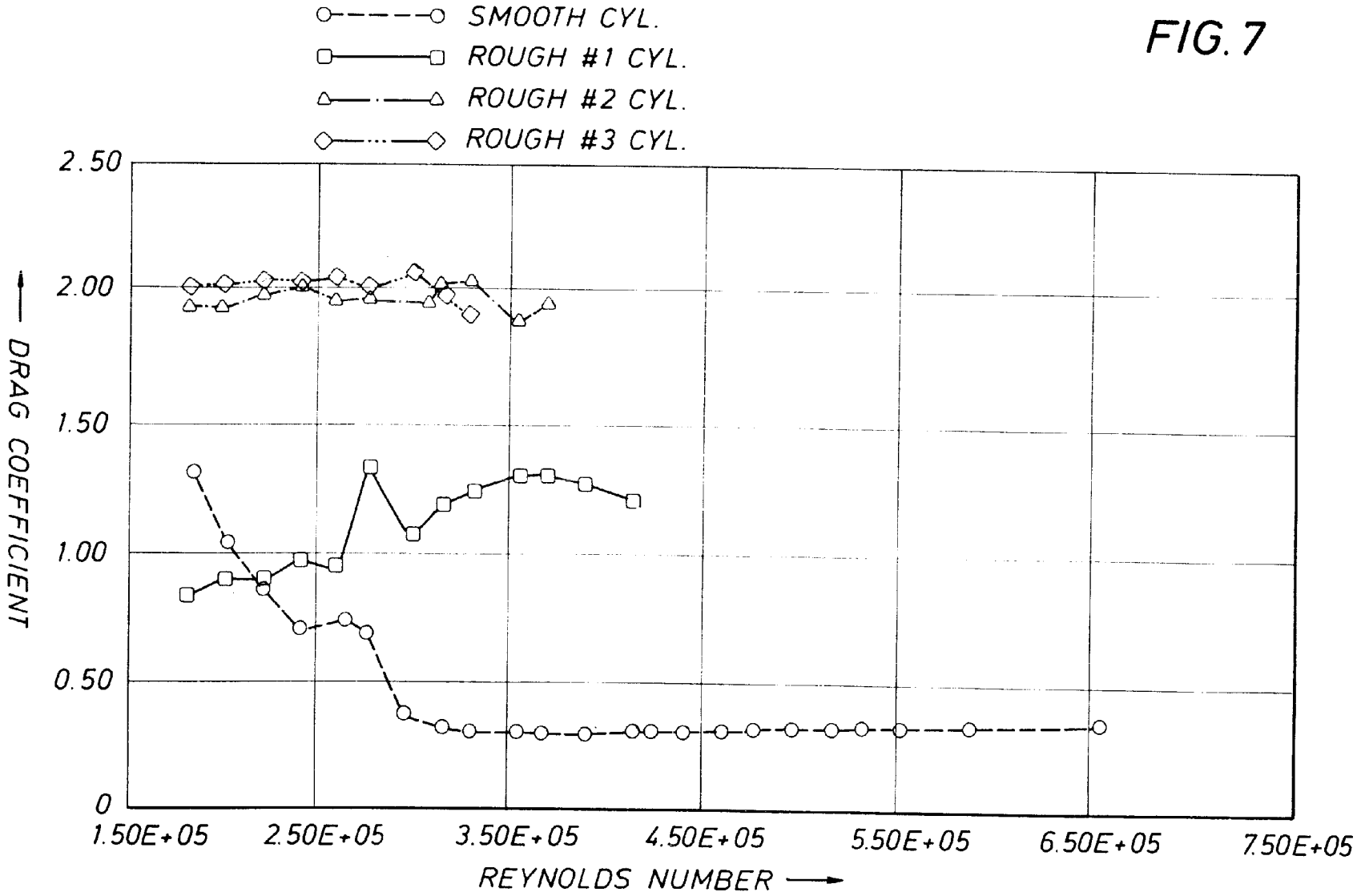
FIG. 7 is a graph of the drag coefficient of cylindrical bodies of varying roughness as a function of the Reynolds number.

FIGS. 7 and 8 depict test results for a towed marine element in a tank to determine the effect of ultrasmooth surfaces and the resultant effect on VIV and drag. FIG. 7 is a graph of the RMS displacement of the element as a function of the Reynolds number for cylinders of varying smoothness, from rough to smooth. As may be seen, all of the test samples appear to see an increase in displacement for a Reynolds number in the range of 250,000 to 300,000. However, the smooth cylinder displacement decreases significantly in excess of 300,000 and exhibits minimal displacement where the Reynolds number is in the range of 350,000 through 600,000; the deflection beginning to increase only slightly in excess of 600,000. It will be appreciated that all of the cylinders see some decrease in displacement with a Reynolds number in the range of 350,000, but the displacement of the rough cylinders is still significant.

FIG. 8 depicts the drag coefficients as a function of the Reynolds number for the same cylinders utilized in FIG. 7. Again, the smooth cylinder's drag coefficient reaches its minimum where the Reynolds number is in the range of 350,000 through 600,000.

The cylinders utilized in the experiments of FIGS. 7 and 8 had the following K/D parameters:

| | |
|---|---|
| Smooth Cylinder: | $5.1 \times 10^{-5}$ |
| Rough #1 | $1.9 \times 10^{-4}$ |
| Rough #2 | $2.5 \times 10^{-3}$ |
| Rough #3 | $5.8 \times 10^{-3}$ |

FIGS. 7 and 8 are indicative of the fact that a low drag coefficient, as achieved by means of a smooth surfaced cylinder decreases the VIV effects in the critical Reynolds number range. As noted above, a decrease in VIV displacement reduces the stress in the risers that may be induced by ocean currents. Moreover, the stability of the riser may allow for multiple production risers to be placed in relatively close proximity to each other during drilling operations. While the above discussion has been primarily in the context of drilling risers, the same techniques may be applicable to other marine structures. The use of smooth surfaces to decreases VIV effects may similarly applied to mooring cables, tendons, spars, or tension legged platform (TLP) and other drilling structures. For instance, its application to a TLP may decrease the requirements for more expensive position maintaining equipment.

The foregoing embodiments of the inventions and their methods of application are non-limiting and have been given for the purpose of illustrating the invention. It will be understood that modifications can made as to its structure, application and use and still be within the scope of the claimed invention. Accordingly, the following claims are to be construed broadly and in a manner consistent with the spirit and scope of the invention.

We claim:

1. An apparatus for reducing drag and vortex induced vibration in a marine buoyancy element, comprising providing a substantially cylindrical buoyancy element having a smooth surface about said marine element, wherein said cylindrical element smooth surface has a K/D ratio of about $1.0\times10^{-4}$ or less, where K is the average peak to trough distance of said smooth surface; and D is the effective outside diameter of said cylindrical element.

2. The apparatus of claim 1, wherein the K/D ratio of $1.0\times10^{-4}$ or less is inherent in the surface of said cylindrical element.

3. The apparatus of claim 1, wherein a coating is applied to the surface of the cylindrical element, resulting in a K/D ratio of $1.0\times10^{-4}$.

4. The apparatus of claim 3, wherein said coating includes marine biological growth inhibitors.

5. The apparatus of claim 3, wherein said coating includes cathodic protection elements.

6. A marine buoyancy element for use in conjunction with a subsea marine element, comprising at least one generally cylindrical buoyancy element affixed to said marine subsea element, said buoyancy element have a smooth surface K/D ratio of $1\times10^{-4}$ or less.

7. The marine buoyancy element of claim 6 wherein said buoyancy element is manufactured from syntactic foam and said K/D ratio is inherent in the surface of said buoyancy element.

8. The marine buoyancy element of claim 6 wherein said K/D ratio is achieved by application of a coating to said marine buoyancy element.

9. The marine buoyancy element of claim 8 wherein said coating includes marine biological growth inhibitors.

10. The marine buoyancy element of claim 8, wherein said coating includes cathodic protection elements.

11. The apparatus of claim 6, wherein:

(a) multiple marine buoyancy elements are affixed to said marine subsea element; and (b) a smooth sleeve is deployed between and about the surface of adjacent marine buoyancy elements, said smooth sleeve having a smooth surface K/D/ratio of $1\times10^{-4}$ or less.

12. The apparatus of claim 6 wherein said marine buoyancy elements are formed as half shells and bolted about said marine elements.

13. The apparatus of claim 12 further including smooth inserts inserted between said half shells and retained together and about said marine element by securing means.

14. The apparatus of claim 12, further including smooth inserts about said securing means.

15. The apparatus of claim 11, further including:

(a) multiple marine subsea elements connected together, each subsea element having at least one marine buoyancy element affixed about it; and (b) a smooth sleeve deployed between and about the surface of a marine buoyancy element on one subsea element and the surface on an adjacent marine buoyancy element on an adjoining marine subsea element.

16. The apparatus of claim 11, wherein said marine buoyancy elements are formed as hinged half shells and are retained about said marine element by securing means.

17. A marine buoyancy system for use in conjunction with multiple adjoining subsea elements, comprising:

(a) at least one marine buoyancy element affixed to each subsea element, said marine buoyancy element sleeve, wherein said marine buoyancy element and is formed as two half shells that are retained about said subsea element by securing means;

(b) smooth surface inserts placed between said marine buoyancy half shells and about said said retaining means, said inserts;

(c) a smooth sleeve deployed between and about the surface of a marine buoyancy element on one subsea element and the surface on an adjacent marine buoyancy element on an adjoining marine subsea element; and (d) smooth sleeves deployed between and about the surface of adjoining marine buoyancy elements on a subsea element;

wherein said marine buoyancy elements, smooth surface inserts and smooth sleeves have a smooth surface K/D/ratio of $1\times10^{-4}$ or less.

18. The system of claim 17, wherein said marine buoyancy elements, smooth surface inserts and smooth sleeves have been treated with biological inhibitor coatings.

19. The system of claim 17, wherein said marine buoyancy elements, smooth surface inserts and smooth sleeves have been treated with cathodic protection coatings.

* * * * *